US007804976B1

(12) United States Patent
Parham

(10) Patent No.: US 7,804,976 B1
(45) Date of Patent: Sep. 28, 2010

(54) RADIANT COOLER FOR LOUDSPEAKERS

(76) Inventor: Wayne Parham, P.O. Box 702006, Tulsa, OK (US) 74170

( * ) Notice: Subject to any disclaimer, the term of this patent is extended or adjusted under 35 U.S.C. 154(b) by 988 days.

(21) Appl. No.: 11/545,407

(22) Filed: Oct. 10, 2006

(51) Int. Cl.
*H04R 1/00* (2006.01)
*H04R 9/06* (2006.01)
*H04R 11/02* (2006.01)
*H04R 25/00* (2006.01)

(52) U.S. Cl. ..... 381/397; 381/150; 381/396

(58) Field of Classification Search ..... 381/397
See application file for complete search history.

(56) References Cited

U.S. PATENT DOCUMENTS 2,261,110 A 11/1941 Engholm
3,358,088 A 12/1967 Gault
3,991,286 A 11/1976 Henricksen
4,210,778 A 7/1980 Sakurai et al.
5,426,707 A 6/1995 Wijnker
5,430,804 A 7/1995 Wijnker
6,005,957 A * 12/1999 Meeks ..... 381/386
6,243,479 B1 * 6/2001 Proni ..... 381/420
6,327,371 B1 12/2001 Proni
6,373,957 B1 * 4/2002 Stewart ..... 381/397
6,390,231 B1 5/2002 Howze
6,535,613 B1 3/2003 Ssutu
7,177,439 B2 * 2/2007 Tardo et al. ..... 381/397

* cited by examiner

*Primary Examiner*—Suhan Ni
*Assistant Examiner*—Matthew Eason
(74) *Attorney, Agent, or Firm*—James F. Harvey, III

(57) ABSTRACT

An apparatus, system, and method is disclosed for providing auxiliary heat dissipating capacity to a loudspeaker assembly. The apparatus comprises a plug that is inserted into a vent at the back of a loudspeaker assembly and extends away therefrom. The plug makes a thermal connection with the pole piece through which the vent is bored, so that the plug conducts at one end the heat from the pole piece that is radiated thereto by the voice coil and radiates this heat to the ambient air at its other end. A plate may be affixed to it other end to provide an additional heat sink for the apparatus. The apparatus may be removable or permanently affixed to the pole piece.

19 Claims, 3 Drawing Sheets

RADIANT COOLER FOR LOUDSPEAKERS

CROSS-REFERENCES TO RELATED APPLICATIONS

Background of the Invention

The present invention generally relates to methods and devices for removing excess heat from loudspeakers.

A loudspeaker is regarded as a transducer that transforms electrical energy into acoustic energy. This is generally accomplished by causing a voice coil suspended between a magnet surrounding the voice coil and an axially-positioned pole piece to move back and forth within a gap between the magnet and the pole piece. The voice coil is usually constructed as a cylindrical form (also known as a former or bobbin) about which an electrical wire is wound and held in place with an adhesive. A modulated electrical signal is routed through the wire comprising the voice coil, which causes an excursion of the voice coil within the gap. This movement varies according to the modulation of the electrical signal. The resulting kinetic energy of the voice coil is transformed into acoustic energy by affixing a diaphragm in the form of a cone to the voice coil. Kinetic energy of the voice coil is thus transferred to the diaphragm, which results in acoustic wave being produced.

However, this transformation from electrical energy to kinetic energy to acoustic energy isn't 100% efficient, so that much of the kinetic energy is dissipated as heat in the wire comprising the voice coil. The most efficient speakers are generally only about 25% efficient, and many are under 1%. The vast majority of loudspeakers are less than 10% efficient, so that heat dissipation becomes a serious concern to those who design loudspeakers. This heat will result in permanent damage to the loudspeaker elements if it is not dissipated, and in fact the most common failure mode of a loudspeaker is caused by thermal stress. The voice coil of high-power loudspeakers may reach temperatures of several hundred degrees, which weakens the adhesive holding in place the wire comprising the voice coil. The coil will eventually unravel and rub against the pole piece causing a buzzing or grinding sound. Ultimately the wire will break and the loudspeaker will fail.

Heat is transferred from the voice coil by three mechanisms, i.e. transfer from the voice coil wire to the former by conduction, transfer to the air forced through the vents by convection, and transfer to the magnet and pole piece by radiation. The conduction path by direct connection to the voice coil is not particularly good, so it is not a very effective cooling method. The contact area in the voice coil between the wire and the former is small, and this thermal interface is poor. In addition, the materials from which the former and diaphragm are fabricated are not usually good thermal conductors. Some methods have been employed to improve heat transfer by conduction through direct conduction with the voice coil, but they have proven to have limited effectiveness. Forced air convection is the method most often employed for loudspeaker cooling. It has proven to be somewhat effective in spite of the fact that voice coil surface area is small. The most common method of forced air convection is to use the motion of the diaphragm to move air within the gap to move across the voice coil and exit the gap through cooling vents in the pole piece and the backplate. Some methods have employed cooling fans to blow air through the gap which helps increase convective airflow, but these methods also increase system complexity and may cause a pressure differential between the front and back of the diaphragm, resulting in cone offset and ultimately increased audio distortion. Heat transfer by radiation has heretofore been largely overlooked in the loudspeaker art; however, radiation as a heat transfer mechanism is simple and effective.

A number of prior art patents have addressed this heating problem in loudspeakers. The use of conduction to cool the voice coil is illustrated by Gault (U.S. Pat. No. 3,358,088), which discloses a voice coil in which the inner surface of the former has a thermally conductive material adhered thereto in order to conduct heat away from the coil.

However, majority of such patents focus on the concept of heat transfer by convection. Engholm (U.S. Pat. No. 2,261,110) discloses a loudspeaker design in which a dome shaped enclosure is shown to prevent debris from entering the air gap within the coil and thus causing problems. As part of this design, Engholm discloses an inner pole piece that is inserted into the coil, having openings about its circumference to allow air to surge back and forth between the chamber, which is located behind the cap and that behind a flexible support for the voice coil. Proni (U.S. Pat. No. 6,243,479) discloses a loudspeaker having a pole piece extending up into the cylindrical space surrounded by the voice coil. The pole piece has an upper end with vent bores spaced around its circumference and an open port at its lower end. A second patent to Proni (U.S. Pat. No. 6,327,371) discloses a loudspeaker similar to that disclosed in the '479 patent, with the voice coil having vent bores spaced circumferentially around the former of the voice coil. These disclosure all illustrate the use of conductive heat transfer.

Sukurai et al. (U.S. Pat. No. 4,210,778) discloses a heat pipe extending rearwardly from the voice coil of a loudspeaker and folded to release the heat outside the enclosure of the loudspeaker. The heat pipe is sealed at both ends and contains a fluid that absorbs heat by evaporation, transfers the heat to the opposing end of the heat pipe, and releases the heat by condensation, all in a closed, adiabatic cycle. The disclosure does not take advantage of the natural convection action present in the interior of the loudspeaker, which is promoted by the pumping action of the diaphragm of the loudspeaker and is one of the few disclosure that illustrate heat transfer by radiation.

The ability of native heat dissipation devices may be exceeded by excess power spikes being intermittently sent to the loudspeaker assembly or by continuous operation at the maximum allowable power. It would be desirable to augment this heat dissipation as necessary by some convenient means. The use of radiation as a heat transfer mechanism, in cooperation with pre-existing modes of heat transfer, would be useful because it is simple and effective. Any temperature difference between the voice coil and the metal elements surrounding it (i.e. the pole piece, the backplate, the top plate, etc.) provides a heat transfer path via radiation. In a typical loudspeaker, the pole piece reaches temperatures that approach that of the voice coil because of radiated heat from the voice coil. If the pole piece is cooler than the voice coil, then this differential in temperature will cause the pole piece to absorb heat radiated from the voice coil. However, if this temperature differential between the pole piece and the voice coil is low, then transfer of heat is not nearly as efficient. It would therefore be desirable to remove heat from the pole piece, so that the pole piece can continue to work as an effective radiant cooler. There is a need for a device that can be retrofit to an existing loudspeaker assembly, which will augment the capacity of the loudspeaker assembly to dissipate excess heat. Furthermore, such a device should work cooperatively with any heat transfer path that may already be in place.

SUMMARY OF THE INVENTION

The invention provides cooling plug that can be inserted into the loudspeaker cooling vent. The invention functions as a heat sink for removing excess heat radiated by the voice coil to the pole piece, by means of conducting the heat from the pole piece and radiating it to the ambient air along the surface of the cooling plug. Additionally, a large metal disk that serves as an auxiliary heat sink may be attached to the cooling plug to provide additional surface area for radiating the excess heat away from the loudspeaker assembly. The cooling plug of the invention cooperates with convective heat transfer methods by allowing the pumping action of the diaphragm to transfer hot air from the vent to be forced through the cooling plug to exit to the ambient air, while simultaneously allowing heat conducted from the pole piece to be radiated to the ambient air along its length and through any heat sink device that may be attached at its end.

In one aspect of the invention, an apparatus is provided for cooling a loudspeaker assembly, where the loudspeaker assembly has a front side from which sound emanates; a back side; and a voice coil surrounded by a magnet and moving freely about a pole piece with a central vent. The apparatus comprises a plug having a first end and a second end, the second end of the plug snugly inserted within the vent with the first end extending away from the back side and the second end being in contact with the pole piece from within the vent, so that heat radiated from the voice coil to the pole piece is conducted away from the pole piece and radiated to the atmosphere by the plug. Additionally, the apparatus may comprise a plate connected to the first end to augment the capacity of the plug to radiate heat.

In another aspect of the invention, a loudspeaker assembly is provided, where the assembly comprises a loudspeaker and a plug. The loudspeaker has a cone, a voice coil attached to the cone, and a pole piece about which the voice coil moves freely, and the pole piece having a central vent and the voice coil radiating heat to the pole piece. The plug has a first end and a second end, the second end of the plug snugly inserted into the vent with the first end extending away from the pole piece, the second end being in contact with the vent to conduct heat away from the pole piece and radiate the heat to the atmosphere.

In still another aspect of the invention, a method of cooling a loudspeaker assembly is provided, where the method comprises the steps of fabricating an apparatus comprising a cylindrical plug with a first end and a second end, the plug having a plate attached to the first end; inserting the second end into a vent of a loudspeaker assembly, the vent extending through a pole piece of the loudspeaker assembly so that the second end frictionally maintains contact with the pole piece to conduct heat radiated from a voice coil to the pole piece away from the pole piece; and conducting heat generated by the pole piece away from the pole piece to the plate, which radiates the heat to the ambient air.

These and other features, aspects, and advantages of the present invention will become better understood with reference to the following drawings, description, and claims.

BRIEF DESCRIPTION OF THE DRAWINGS

FIG. 5 shows a loudspeaker assembly having a cooling plug that is removably attached to a vent in the pole piece, according to an embodiment of the invention.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Broadly, the current invention includes systems, devices, and methods for cooling the voice coil of a loudspeaker by radiation. The invention provides a cooling plug that may be sized to manual insertion into the loudspeaker cooling vent, which extends through a central pole piece about which the voice coil moves, and held therein by means of friction. The cooling plug makes physical contact with the pole piece so that heat radiated by the voice coil to the pole piece is conducted away from the pole piece to a large metal disk attached to the opposing end of the cooling plug, which serves as a heat sink. The apparatus thus radiates to the ambient air the heat generated by the coil and serves as a heat exchanger.

The invention may be retrofit to an existing loudspeaker or may be included as an integral part of the loudspeaker assembly. Since heat is conducted away from the immediate vicinity of the voice coil, the voice coil may operate at a lower temperature and be less prone to destructive heat build up that may melt insulation about the electrical wires of the coil, causing it to fail. The invention does not depend solely upon convection of the air within the speaker assembly to cool the voice coil but instead incorporates the additional thermal paths of conduction and radiation. The invention provides this kind of cooling, and it also cooperatively works with vents in the pole piece and the backplate to allow forced air convection to operate as well.

Figure 1:
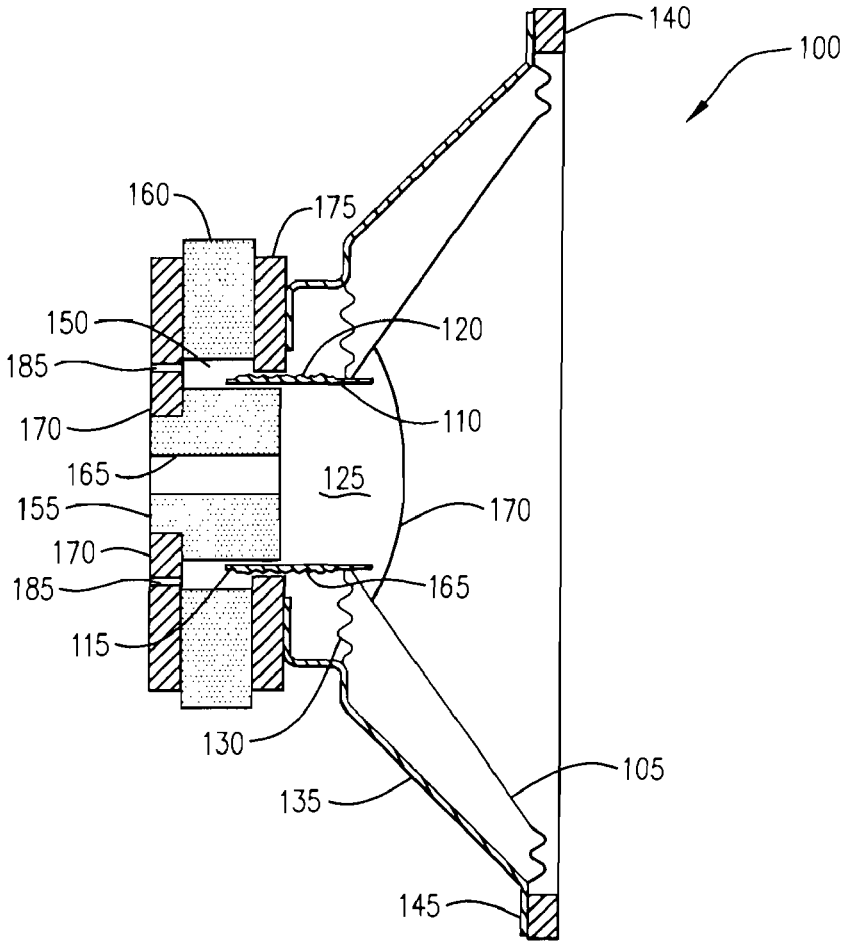
FIG. 1 (PRIOR ART)
FIG. 1 shows a generic loudspeaker assembly according to the prior art.

Referring now to FIG. 1, a generic loudspeaker assembly 100 is illustrated for reference purposes. The loudspeaker assembly 100 has a cone-shaped diaphragm 105 connected to a voice coil 110 which actuates the diaphragm 105 to produce audible sound waves. The voice coil 110 may be constructed as a cylindrical form 115 made from any heat-resistant material, about which is wound a wire coil 120 that is affixed to the form 115. The wire coil 120 may have an insulation coating typically fabricated of such materials as shellac, epoxies, or varnish.

The voice coil 110 may define a chamber 125 therein. The form 115 may be attached to an element known in the art as a spider 130. The spider 130 may be fabricated typically from a resin impregnated, clothlike material and may have concentric, circular corrugations formed therein. The spider 130 may resiliently hold the voice coil 110 in position with respect to a frame 135, which is typically fabricated from a rigid, metallic material. Alternatively, the spider 130 may be integral with the form 115. The frame 135 may be attached to the speaker enclosure (not shown) by a gasket 140 placed between a rim 145 of the frame and the speaker enclosure. The diaphragm 105 may be fabricated from well-known materials and is attached to the form 115 at one end, while attached to the rim 145 at the other end, possibly with the use of gasket 140. The rim 145 may be attached to the frame 135.

The voice coil 110 may operate in a conventional manner in an annular gap 150, which is positioned between a center pole piece 155 and an annular magnet 160. The pole piece 155 may optionally have a vent 165 through its central axis so that air in the chamber 125 communicates with the ambient air. The pole piece 155 and magnet 160 may cause the mechanical actuation of the voice coil 110 and the form 115 in and out of the chamber 125 in response to electrical signals received by the voice coil 110. Since the voice coil 110 is attached to the diaphragm 105 at its outer end, the diaphragm 105 mechanically vibrates in response to produce acoustic waves. A backplate 170 and top plate 175 may secure the pole piece 155 and magnet 160 in place with respect to the frame 135 and direct the magnetic field from the magnet 160. Peripheral air vents 185 may sometimes be provided through the backplate 170 for a return air path for the vent 165. A protective dust cap 180 may be placed over the chamber 125.

When the electrical signal or current is supplied to the voice coil 110, the diaphragm 105 vibrates in accordance with the audio frequency and polarity of the electrical signal. The winding used to form the wire coil 120 has an electrical resistance to the flow of current and generates heat. This heat increases the temperature within the loudspeaker assembly 100 and its enclosure. As heat is generated in the voice coil 110, it is dissipated by three processes. First, the heat may be conducted away from the voice coil 110 by means of both the thermally conductive form 115. Second, heat may be convected away by forced air passing through the vent 165 and the peripheral cooling vents 185. Finally, heat may be radiated by the voice coil 110 to the magnet 160, pole piece 155, top plate 175 and backplate 170, all of which surround the voice coil 110. For high power loudspeaker systems, the temperature of the voice coil 110 and its enclosure correspondingly increases. Heat sinks may be provided in addition to the top plate 175 to dissipate the excess heat, but sometimes the heat may exceed the dissipative capacity of these components, resulting in damage to the loudspeaker assembly.

Figure 2:
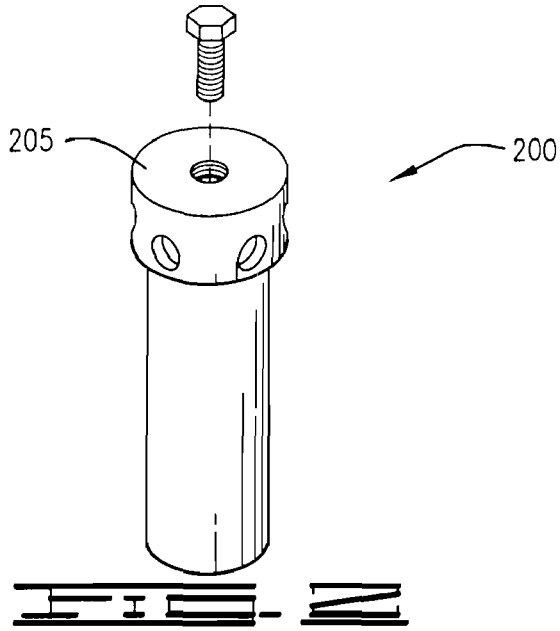
FIG. 2 shows a perspective view of a cooling plug, according to an embodiment of the invention.
Figure 3:
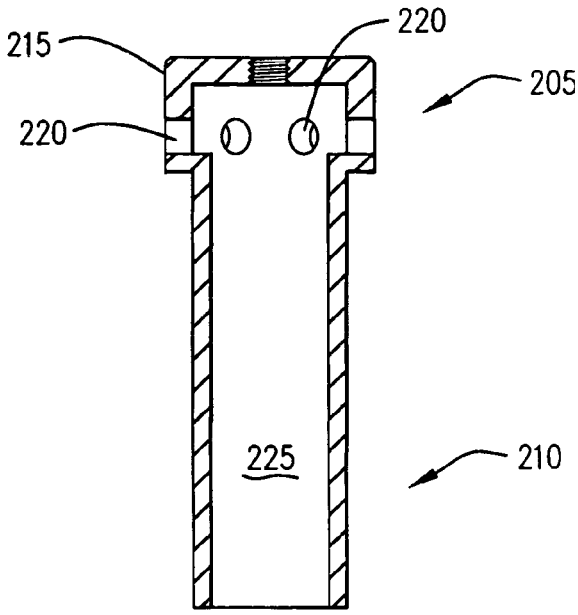
FIG. 3 shows a cross-section of a cooling plug, according to an embodiment of the invention.

Referring now to FIGS. 2 and 3, a cooling plug 200 is shown according to an embodiment of the invention. As can be seen from the figure, the cooling plug 200 may comprise a cylinder or tube of arbitrary length. The length of the cooling plug 200 may be a design choice according to the manufacturer of the loudspeaker assembly or the enclosure within which it is to be installed, but as the length of the cooling plug 200 increases, its surface area also increases so that more heat may be dissipated. Heat transfer between the pole piece and the cooling plug 200 may be maximized by inserting an end of the cooling plug 200 into the vent 165 so that the entire inner surface area of the vent 165 may be in contact with the cooling plug 200. A first end 205 of the cooling plug 200 may optionally have a knob 215 with holes 220 radially positioned about the circumferential wall of the knob 215 so that the interior 225 of the cooling plug 200 is in communication with the ambient air. The holes 220 may have the function of allowing heated air being pumped in and out of the chamber 125 of the loudspeaker assembly 100 to be vented to the ambient air, so as to provide an additional means for cooling the loudspeaker assembly 100.

The cooling plug 200 may be fabricated from any heat conductive material, such as aluminum, stainless steel, copper, and the like. It may be preferably machined from single billet of metal, such as aluminum, although separate portions may be fabricated and permanently attached to one another using standard means well known in the art, without departing from the scope of the invention.

Figure 4:
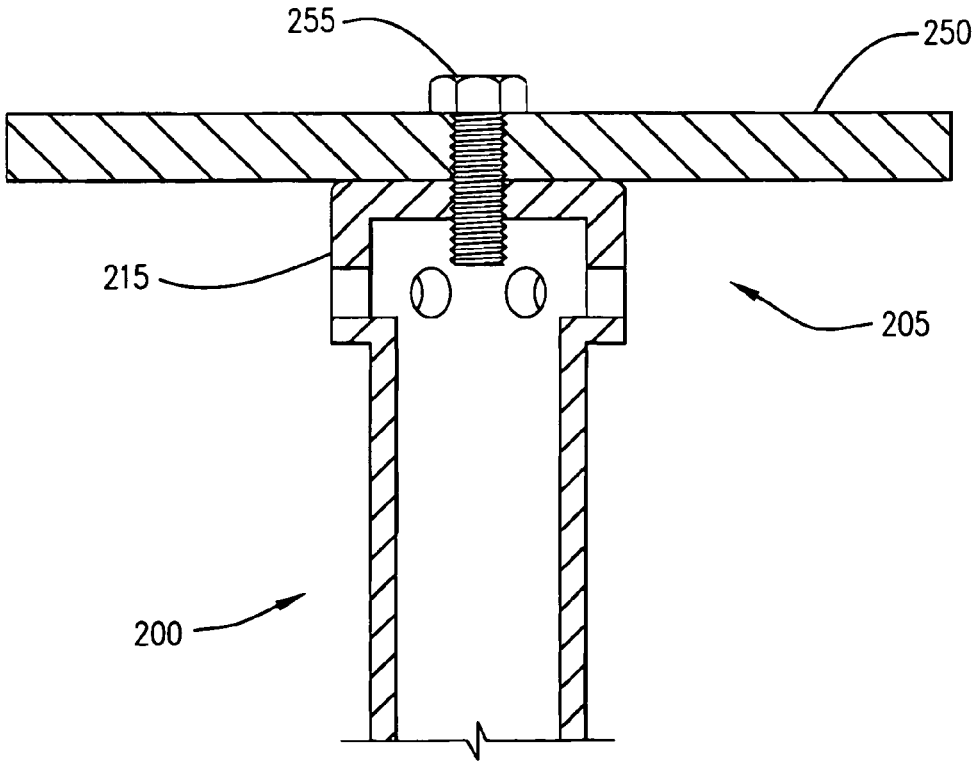
FIG. 4 shows a cross section of a cooling plug with a plate attached thereon, according to an embodiment of the invention.
Figure 3:
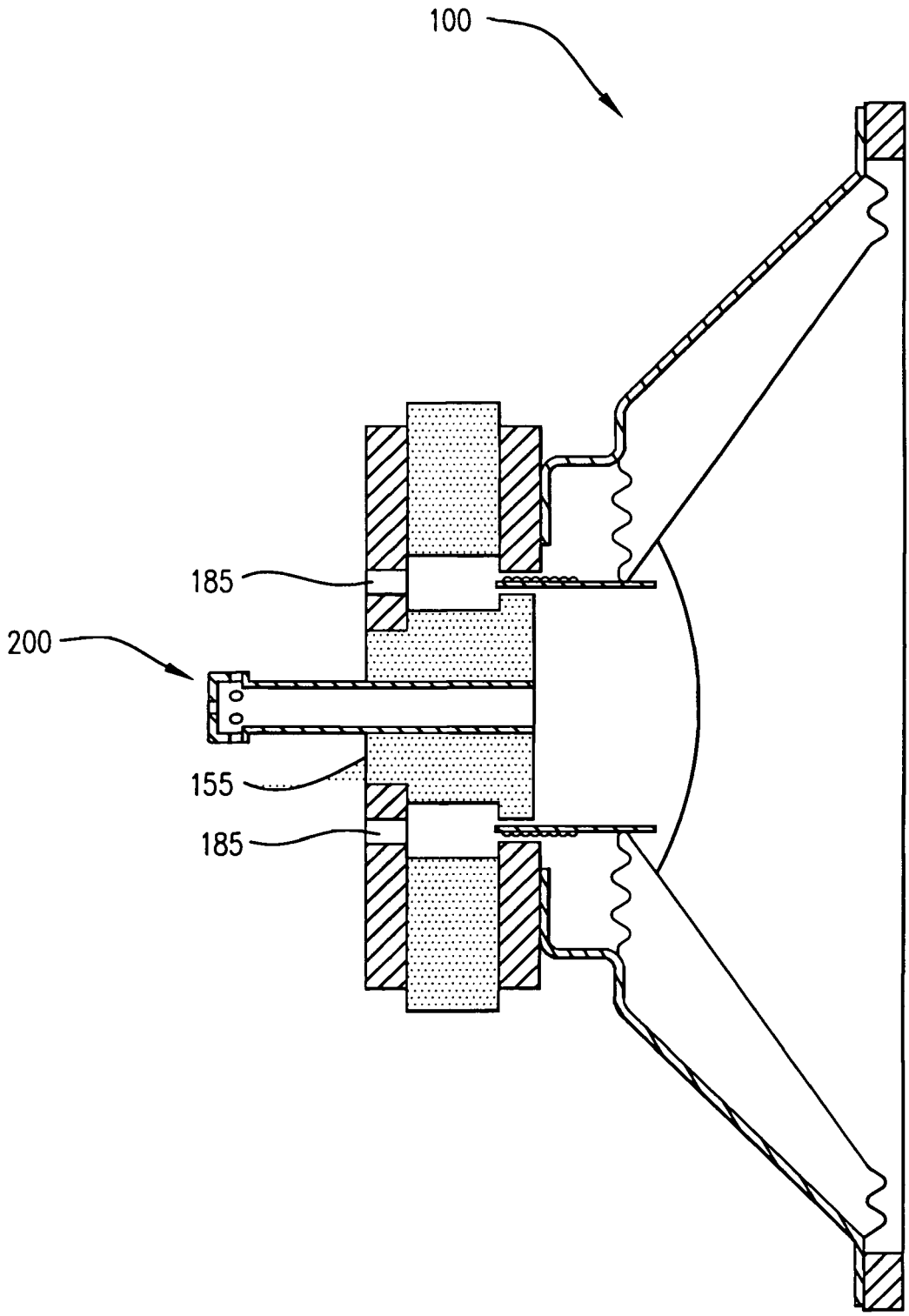

Referring now to FIG. 4, a plate 250 is shown removably attached to the first end 205 of the cooling plug 200. Like the cooling plug 200, the plate 250 may be fabricated from any heat conductive material, such as aluminum, stainless steel, copper, and the like. However, the materials comprising the cooling plug 200 and the plate 250 should be chosen so that a dielectric is not created or so that corrosion is not promoted by dissimilar materials. Where a thermal junction exists, heat conductive grease may be employed along the top 205 of the cooling plug 200 to reduce thermal resistance and improve heat transfer. Also, the top 205 may be machined so that it is smooth and mates closely with the plate 250. The shape of the plate 250 may be arbitrary, although for aesthetic reasons it may be in the shape of a circular disk. The plate 250 may also contain grooves or fins to increase radiating surface area. Other shapes and sizes of the plate 250 may be chosen without departing from the scope of the invention. In the embodiment shown, the plate 250 may be attached to the knob 215 of the cooling plug 200 by a bolt 255 inserted through the plate 250 and fastened into a threaded hole in the knob 215. A thermal connection may be maintained between the plate 250 and the cooling plug 200 by fabricating the bolt 255 from a heat conducting material compatible with the material comprising the plate 250 and the cooling plug 200. Alternatively, the plate 250 may be permanently affixed to the knob 215 by means of welding, braising, heat-conducting epoxy, and the like. Any such means may be used without departing from the scope of the invention, as long as a thermal connection is maintained between the plate 250 and the cooling plug 200.

Referring now to FIG. 5, the cooling plug 250 may be removably inserted into the vent 165 of the loudspeaker assembly and held therein by friction. The diameter of the cooling plug 200 may be sized appropriately for snug fit of the second end 210 of the cooling plug 200 within the vent 165. Alternatively, the cooling plug 250 may be removably affixed to the pole piece 155 by providing internal threads within the vent 165 to receive an externally threaded second end 210 of the cooling plug 200. Any means of removably inserting and affixing the cooling plug 200 to the vent 165 may be used without departing from the scope of the invention, as long as a thermal connection having maximum contact surface area is maintained between the cooling plug 200 and the walls of the pole piece 155.

The cooling plug 200 disclosed by this specification may be used as part of a method for augmenting the cooling capacity of a loudspeaker assembly. First, an appropriately sized cooling plug 200 may be fabricated with a diameter compatible with the vent of a selected loudspeaker assembly. Next, the cooling plug 200 may be inserted within the vent 155 of the selected loudspeaker assembly 100 so that maximum thermal contact is made between the pole piece 155 and the cooling plug 200, with the opposing end of the cooling plug 200 extending a distance away from the back plate 170 of the loudspeaker assembly 100. Next, heat generated by the may be conducted away from the voice coil 110 through the cooling plug 200 for radiation to the ambient air. The plate 250 may be affixed to the end of the cooling plug 200 to provide additional dissipative capacity to the apparatus.

As can be seen, the invention provides an apparatus, a system, and a method for providing additional heat dissipating capacity to a loudspeaker assembly, which can be installed and removed without special tools or dismantling of the loudspeaker assembly. It should be understood, of course, that the foregoing relates to exemplary embodiments of the invention and that modifications may be made without departing from the spirit and scope of the invention as set forth in the following claims.

We claim:

1. An apparatus for cooling a loudspeaker assembly, the loudspeaker assembly having a front side from which sound emanates and a backplate, the loudspeaker assembly having a voice coil surrounded by a magnet and moving freely about a pole piece having a central vent with an inner surface, wherein the apparatus comprises a plug having a first end and a second end, the second end of the plug removably and snugly inserted into the vent, the first end extending a distance away from the backplate so that a plug portion extending the distance is exposed to ambient air, the second end being in contact with the inner surface of the central vent, wherein heat radiated from the voice coil to the pole piece is conducted away from the pole piece and radiated to ambient air by the plug portion that extends away from the backplate;

wherein the plug is inserted through the backplate into the vent without disassembly of the loudspeaker assembly.

2. The apparatus described in claim 1, wherein the plug is hollow and a hole in the first end of the plug provides communication between the ambient air and an interior portion of the plug, wherein heated air within a gap between the magnet and the pole piece is conducted through the plug by convection to exit through the hole to the ambient air.

3. The apparatus described in claim 2, wherein the first end has holes about its circumference.

4. The apparatus described in claim 2, wherein the plug is cylindrical.

5. The apparatus described in claim 1, wherein the apparatus further comprises:

a plate connected to the first end, so that heat conducted by the plug is radiated by the plate to the ambient air.

6. The apparatus described in claim 5, wherein the plate is removably connected to the first end.

7. The apparatus described in claim 5, wherein the plate is fixedly connected to the first end.

8. A loudspeaker assembly comprising a loudspeaker having a cone, a voice coil attached to the cone, and a pole piece about which the voice coil moves freely, the pole piece with a central vent providing communication from the voice coil to the ambient air through a backplate, the voice coil radiating heat to the pole piece;

a plug having a first end and a second end, the second end of the plug snugly inserted into the vent through the backplate, the first end extending a distance away from the pole piece so that a plug portion extending the distance is exposed to ambient air, the second end being in contact with an inner surface of the central vent to conduct heat away from the pole piece and radiate the heat to ambient air by the plug portion;

wherein the plug is inserted through the backplate into the vent without disassembly of the loudspeaker assembly.

9. The apparatus described in claim 8, wherein the plug is hollow.

10. The apparatus described in claim 9, wherein the first end has holes about its circumference.

11. The apparatus described in claim 8, wherein the plug is cylindrical.

12. The apparatus described in claim 8, wherein the plug is removably inserted into the vent from a back side of the loudspeaker assembly.

13. The apparatus described in claim 8, wherein the apparatus further comprises:

a plate connected to the first end, so that heat conducted by the plug is radiated by the plate to the ambient air.

14. The apparatus described in claim 13, wherein the plate is removably connected to the first end.

15. The apparatus described in claim 13, wherein the plate is fixedly connected to the first end.

16. A method of cooling a loudspeaker assembly comprising the steps of:

fabricating an apparatus comprising a cylindrical plug with a first end and a second end, the plug having a plate attached to the first end;

inserting the second end into a vent of a loudspeaker assembly, the vent extending through a pole piece of the loudspeaker assembly and an external backplate so that the second end frictionally maintains contact with the pole piece to conduct heat radiated from a voice coil to the pole piece away from the pole piece;

allowing a plug portion to extend a distance from the backplate so that it is exposed to ambient air;

conducting heat generated by the pole piece away from the pole piece to the plate; and radiating heat to the ambient air from the plug portion and the plate.

17. A method of cooling a loudspeaker assembly described in claim 16, wherein the step of inserting the second end into the vent comprises removably inserting the second end into the vent.

18. The apparatus described in claim 5, wherein the plate has fins.

19. The apparatus described in claim 1, wherein the plug is solid.

* * * * *